US005189881A

United States Patent [19]

Miles

[11] Patent Number: 5,189,881

[45] Date of Patent: Mar. 2, 1993

[54] REFRIGERANT RECOVERY APPARATUS AND METHOD

[76] Inventor: Lee A. Miles, 300 S. Val Vista Dr., Sp. 161, Mesa, Ariz. 85204

[21] Appl. No.: 780,031

[22] Filed: Oct. 21, 1991

[51] Int. Cl.[5] ..... F25B 45/00

[52] U.S. Cl. ..... 62/77; 62/292; 62/125; 165/104.19

[58] Field of Search ..... 62/77, 85, 149, 195, 62/292, 475; 165/104.19

[56] References Cited

U.S. PATENT DOCUMENTS 4,688,388 8/1987 Lower et al. ..... 62/149

4,998,413 3/1991 Sato et al. ..... 62/149

*Primary Examiner*—John M. Sollecito

*Attorney, Agent, or Firm*—Harry M. Weiss

[57] ABSTRACT

A refrigerant recovery system or apparatus and method for moving a liquid refrigerant from a refrigerator system to a storage cylinder remotely located from the refrigerator. This system includes a chiller unit, and a piping circuit for connection to the refrigerator system, and a storage cylinder connected to the piping circuit and disposed within the chiller unit.

8 Claims, 2 Drawing Sheets

REFRIGERANT RECOVERY APPARATUS AND METHOD

The invention generally relates to a refrigerant recovery apparatus and method, and, in particular the invention relates to a refrigerant recovery apparatus and method having a piping circuit for recovering liquid refrigerant and for removing refrigerant vapor from a remotely located refrigerator.

BACKGROUND OF THE INVENTION

The prior art refrigerant recovery apparatus had the problem of locating the refrigerant recovery apparatus adjacent to the refrigerator; and this required carrying the refrigerant recovery apparatus to the location of the refrigerator which might be in a difficult location, such as in a hard to get to area in a building, on a roof or in an area where there is a tightly limited building floor space.

SUMMARY OF THE INVENTION

One object of the present invention is to provide an improved refrigerant recovery apparatus and method which apparatus can be located at a remote location away from a refrigerator to be drained or emptied of its refrigerant.

Another object of the present invention is to provide an improved refrigerant recovery apparatus and method which permits refrigerant liquid to be moved from a refrigerator to a storage cylinder, and which can also evacuate refrigerant vapor.

The foregoing and other objects, features and advantages will be apparent from the following description of the preferred embodiment of the invention as illustrated in the accompanying drawings.

BRIEF DESCRIPTION OF THE PREFERRED EMBODIMENT

According to the present invention a refrigerant recovery apparatus is provided. This apparatus comprises a chiller unit, a cylinder removably disposed in the chiller unit, a piping circuit having a line connected to the cylinder, an elongate flexible line connected at one end to the piping circuit for connection at a second end to a remotely located refrigerator, whereby refrigerant liquid is moved from the refrigerator to the cylinder by lowering the temperature of the cylinder. By using the chiller unit for moving the refrigerant liquid to the cylinder, and by using an elongate flexible line to the refrigerator, the prior art problem of carrying the refrigerant recovery apparatus to the very often difficult location of the refrigerator is avoided.

Also, according to the invention, a refrigerant recovery method is provided. This method includes the steps of, mounting a chiller unit at a convenient location; disposing a storage cylinder in the chiller unit; connecting a piping circuit through a shutoff valve to the storage cylinder; connecting a flexible elongate hose at one end through a connection to the piping circuit, connecting the flexible elongate hose through a shutoff valve to a refrigerator containing a liquid refrigerant which is at the temperature of the cylinder; and opening the shutoff valves.

DESCRIPTION OF THE PREFERRED EMBODIMENT

Figure 1:
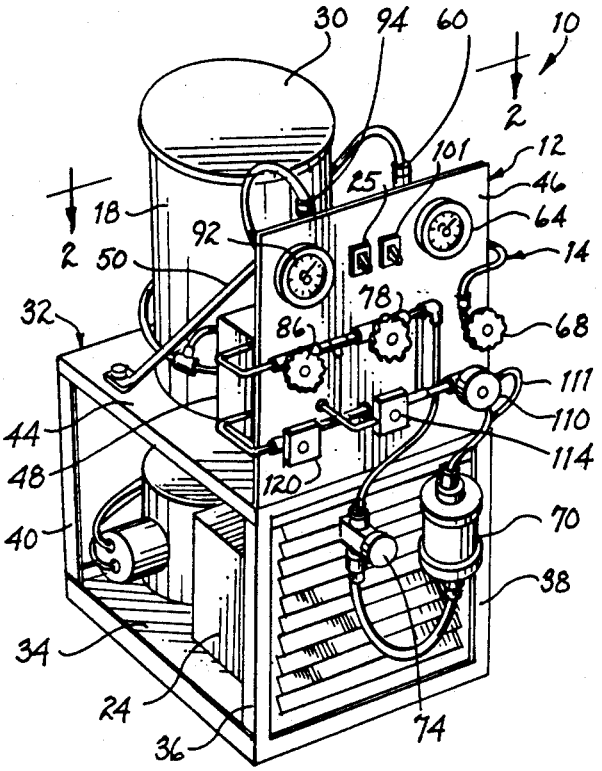
FIG. 1 is a perspective view of a refrigerant recovery apparatus according to the present invention.

As shown in FIG. 1, a refrigerant recovery apparatus 10 is provided. Apparatus or unit 10 includes a chiller subassembly or unit 12, a piping circuit 14, and a storage cylinder 16 (see FIGS. 2A, and 3), which connects to piping circuit 14 and which is disposed in chiller unit 12.

Figure 2:
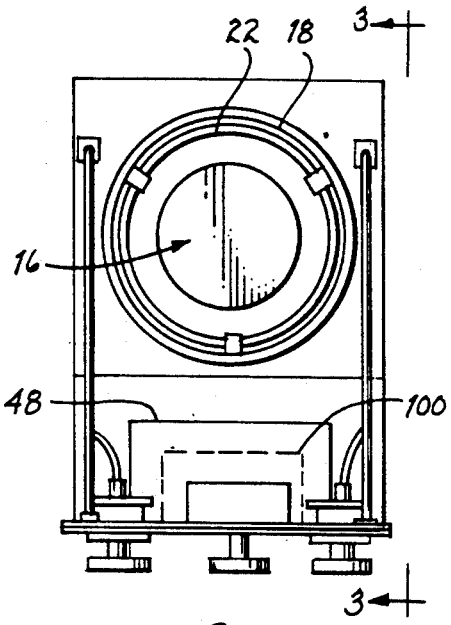
FIG. 2 is a sectional view taken along the line 2—2 of FIG. 1.
Figure 3:
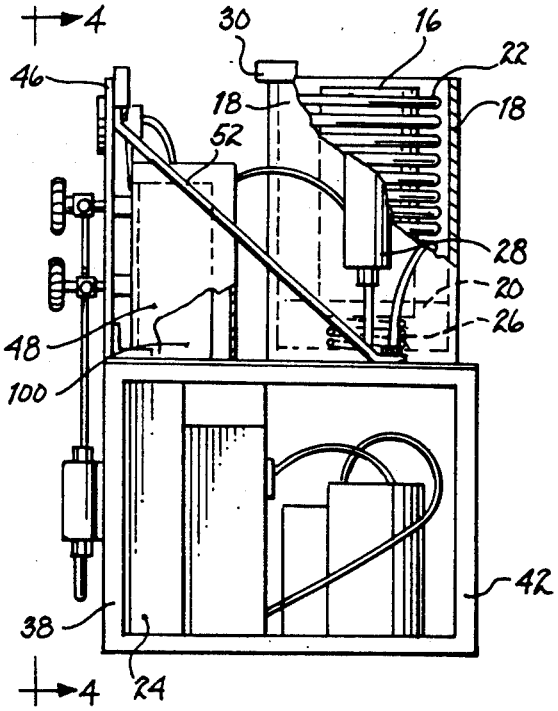
FIG. 3 is a side elevational view taken along the line 3—3 of FIG. 2.

As shown in FIGS. 1, 2 and 3, chiller unit 12 includes a drum 18 which has a brine solution 20 therein (see FIG. 3), a chiller coil 22 which is disposed in drum 18, a fan-type condenser 24 (see both FIGS. 1 and 2), a chiller power switch 25 (see FIG. 1), and a spring supported platform 26 (see FIG. 3) which is disposed in drum 18 and which supports cylinder 16. Drum 18 has a brine liquid level gauge 28 (see FIG. 3) which displays the weight and amount of refrigerant liquid in cylinder 16. Drum 18 also has a cover 30 (see FIGS. 1 and 3).

Chiller unit 12 has a support 32 (see FIG. 1). Support 32 has a lower plate 34, left and right front legs 36, 38, left and right rear legs 40, 42 (see FIG. 3) and an upper plate 44. Lower plate 34 supports condenser 24. Upper plate 44 supports drum 18. Upper plate 44 supports a vertical bracket 48 (see FIGS. 1, 2 and 3). Vertical plate 46 (see FIGS. 1, 3 and 4) has left and right diagonal braces 50 (see FIG. 1), 52 (see FIG. 3). Condenser 24 has a louver 54 (see FIG. 4).

Figure 5:
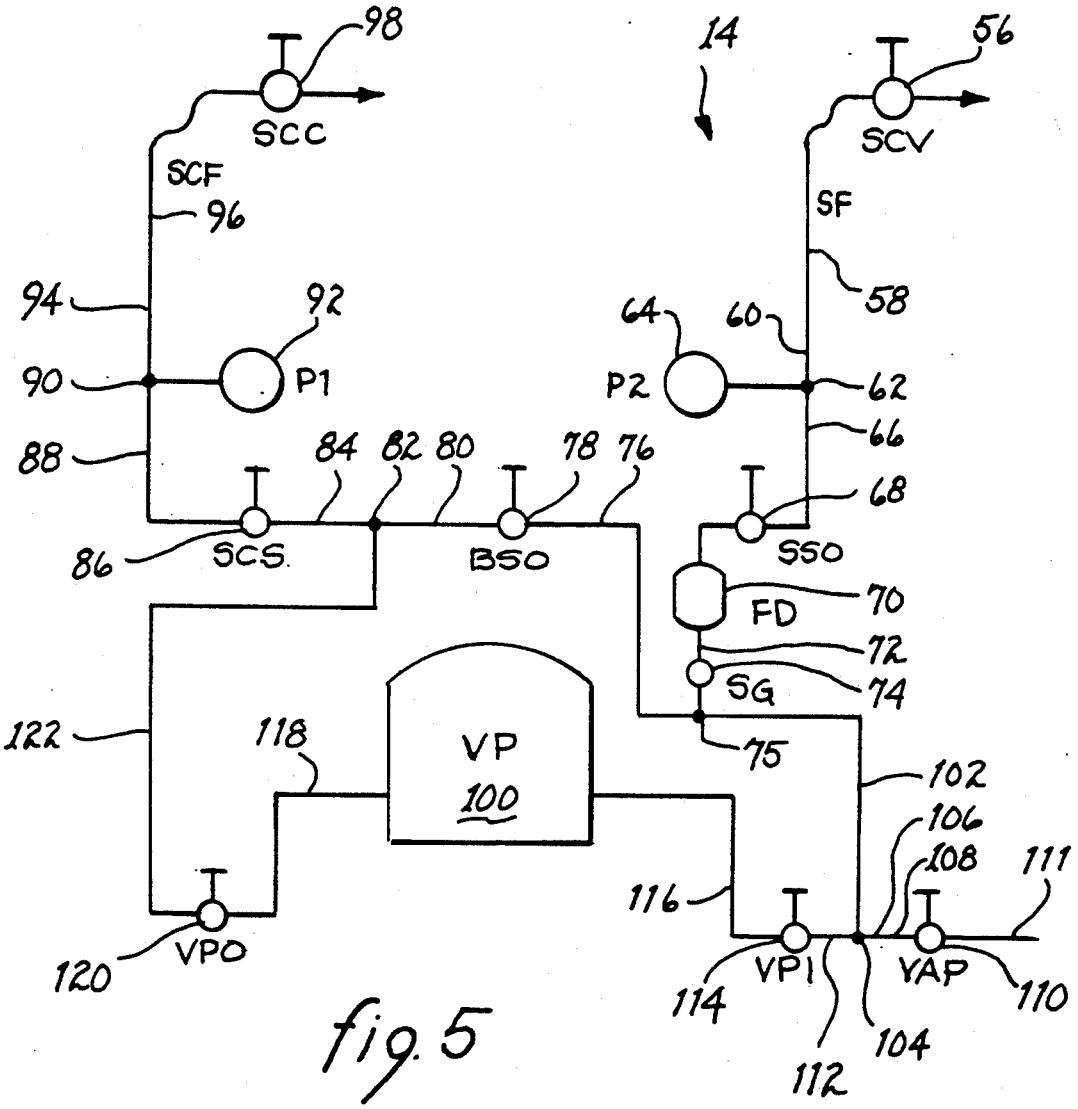
FIG. 5 is a schematic diagram of the refrigerant recovery apparatus.

As shown in FIG. 5, piping circuit 14 includes a system control valve (SCV) 56. Valve 56 connects through a system flexible (SF) hose 58 to a system hose connection 60 that connects to an inlet of a first tee fitting 62 that connects through a first outlet to a pressure gauge (P2) 64. Tee 62 connects through a second outlet to a tube 66. Tube 66 connects to an inlet of a system control valve (SSO) 68, which connects to a filter/drier (FD) assembly 70 which connects to a tube 72 that connects to an inlet of a sight glass (SG) 74. Sight glass 74 connects through an outlet to a second tee fitting 75. Tee 75 connects to a tube 76. Tube 76 connects to an inlet of a liquid bypass valve or vapor pump bypass (BSO) 78.

Valve (BSO) 78 connects through an outlet to a tube 80. Tee 82 connects through an outlet to a tube 84 that connects to an inlet of a storage cylinder control valve or shutoff valve (SCS) 86. Valve (SCS) 86 connects through an outlet to a tube 88, that connects to an inlet of a fourth tee fitting 90. Fourth tee 90 connects through an outlet to a storage cylinder pressure gauge (P1) 92. Fourth tee 90 has a cylinder hose connection 94 which connects to a storage cylinder flexible hose (SCF) 96 which connects to an inlet of a storage cylinder control valve (SCC) 98 which connects to the cylinder 16 (not shown in FIG. 5—see FIGS. 2 and 3).

Figure 4:
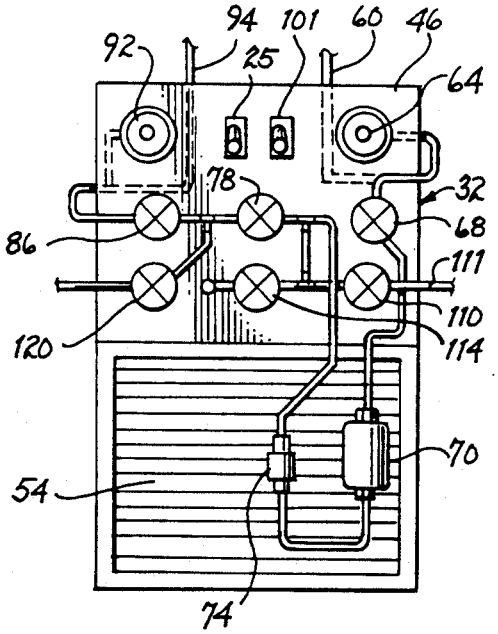
FIG. 4 is a side elevational view taken along the line 4—4 of FIG. 3.

As shown in FIG. 5, piping circuit 14 also includes a vapor pump 100, which has a power switch 101 (FIG. 4). Tee 75 connects through a second outlet to a tube 102, which connects to an inlet of a fifth tee fitting 104. Tee 104 connects through a first outlet 106 to a tube 108. Tube 108 connects to an external vacuum pump control valve (VAP) 110, which has a vacuum pump connection 111. Tee 104 connects through a second outlet to a tube 112. Tube 112 connects to an inlet of a vapor pump inlet control or shutoff valve (VP1) 114. Valve 114 connects through an outlet to a tube 116. Tube 116 connects to an inlet of vapor pump 100. Pump 100 connects through an outlet to a tube 11S. Tube 118 connects to an inlet of a vapor pump outlet control valve (VPO) 120. Valve 120 connects through an outlet to a tube 122. Tube 122 connects to a second inlet of tee 82.

OPERATION

In operation, the refrigerant recovery unit 10 depends on a pressure difference between the refrigeration system that is to be emptied of refrigerant (not shown) and the storage cylinder 16. The pressure difference is created by reducing the temperature of the storage cylinder 16 below the system temperature. This is accomplished by immersing the storage cylinder 16 in the (refrigerated Glycol) brine bath 20. By means of the various valves of the piping circuit 14, the refrigerant (from the refrigeration system that is to be emptied of refrigerant) is removed in the liquid state using the pressure difference created by the temperature difference. When all the liquid state refrigerant has been removed from the refrigeration system (not shown), the remaining vapor is removed via the vapor pump 100. The operating principle of using pressure differential to move refrigerant allows the use of extended length refrigerant hoses. This eliminates carrying the recovery unit up on to the roof of a building or into tight areas. The only adverse effect of using longer refrigerant lines is the small additional amount of time needed to transfer the refrigerant, however, this amount of time may be substantially less than the time needed to place a prior art refrigerant recovery apparatus adjacent to hard to reach refrigeration system.

In the method of operation, refrigerant liquid recovery is first accomplished . After the temperature of the storage cylinder 16 has been reduced to a pressure lower than the pressure in the system, the system (VAP) valve 110, the liquid flow (SSO) valve 68 and the storage cylinder (VPI) valve 112 are opened which allows liquid refrigerant to flow directly from the system (not shown) to be emptied of refrigerant through the filter/-drier (FD) 70 and sight glass (SG) 74 to the storage cylinder 16. The storage cylinder 16 is on a spring supported platform 26 (see FIG. 3) that allows the platform to sink into the brine solution 20 as the weight of the cylinder 16 increases. As the platform 26 and cylinder 16 descend into the brine 20, the brine 20 is forced up the sides of the cylinder 16, between the cylinder 16 and the chiller coil 22 and drum 18. When the height of the brine liquid reaches the "full" level notation on depth gauge 28 for the particular refrigerant, the cylinder 16 contains the maximum amount of refrigerant and must be shut off. Systems (not shown) holding more than the selective maximum amount (or about 30 pounds) of refrigerant will require multiple storage cylinders 16 for the total quantity of refrigerant in the system.

Vapor refrigerant recovery is then accomplished in this refrigerant evacuation operation, with liquid refrigerant recovery flowing directly into the storage cylinder 16, the vapor (VP) pump 100 does not have the risk of damage due to pumping liquid refrigerant. After the system pressure has been reduced below the pressure equivalent of the system temperature, the refrigerant evacuation process can be accelerated by using the vapor (VP) pump 100 to increase the flow rate. This allows the system pressure to be reduced to a selective pressure (not shown) or a pressure between 2 to 5 (Psig) pounds per square inch gauge. At this pressure, when the system (not shown) is opened, a very small amount of refrigerant will escape to the atmosphere. In this embodiment, the recovery rate amounts to about 99.9+% of the system charge.

In this embodiment of unit or apparatus 10, there are some limitations. For example, storage of the recovered refrigerant is in 30 pound storage cylinders 16. This permits easier handling of lighter cylinders. The 30 pound storage cylinder 16 capacity means that the recovery apparatus or unit 10 will empty most refrigerant systems (not shown) in the residential and small commercial field with the use of only one storage cylinder 16. For larger refrigerant systems, multiple storage cylinders 16 will be used with only the necessary chill (being down in temperature) time for each additional cylinder.

As another example, unit 10 can be used with or for all refrigerant systems that are compatible with copper and aluminum materials. The unit 10 cannot be used where there is ammonia.

As further example, when changing the usage from one type of refrigerant to another, it is necessary to first thoroughly evacuate the unit 10 by means of a separate evacuation pump (not shown).

As a still further example, refrigerant systems that fail due to high acid content in the refrigerant are evacuated in the liquid refrigerant state by connecting the refrigerated system (not shown) directly to the chilled storage cylinder 16 without having the acid contaminated refrigerant flow through the recovery unit 10. To remove as much refrigerant vapor as possible and to reduce the amount purged to atmosphere, the recovery unit 10 is operated with a storage drum pressure/temperature equivalent of about −15° F. or colder.

The operating procedure for the normal non-acid refrigerant system (not shown) is indicated hereafter.

A. Check the brine level in the chiller drum 18 to make sure it is at the proper height on the depth gauge 28.

B. Insert a storage cylinder 16 in the chiller coil 22 and start the recovery unit refrigeration system or chiller unit 12.

C. Connect the recovery unit 10 to t he system control (SCV) valve 56 using the necessary length of refrigerant (SF) hose 58 connected between the liquid line gauge connection (not shown) on the refrigerant system (not shown) and the recovery unit system hose connection 60. The maximum recommended length of refrigerant hose (not shown) is preferably about 50 feet. The shut off (SCV) valve 56 on the system end of the connecting (SF) hose 58 must remain closed until after the recovery unit 10 has been evacuated.

D. Connect the recovery unit outlet (SCF) hose 96 to the storage cylinder control (SCC) valve 98.

E. Connect a vacuum pump (not shown), which is the pump used to evacuate the system prior to charging, to the vacuum pump connection 111.

F. Start the vacuum pump (not shown).

G. Open the vacuum pump shut off (VAP) valve 110, the system shut off (SSO) valve 68, the liquid flow (BSO) valve 78 and the storage cylinder shut off (SCS) valve 86.

H. When the system pressure is about 25 inches of vacuum or more, open the vapor pump discharge (VPO) valve 120 to allow the pressure in the vapor (VP) pump 100 to be reduced without a rapid pressure reduction.

I. When the unit 10's internal pressure is again below 25 inches of vacuum, open the vapor pump inlet (VPI) valve 114 (see both FIGS. 5 and 4). Allow the vacuum pump (not shown) to operate until it reaches its lowest pressure balance point. This should be about 500 microns or less in this embodiment.

J. After evacuation, close all the (six) valves on the recovery unit control panel (see FIG. 4) and disconnect the vacuum pump (not shown).

K. Open the system (SCV) valve 56 at the system end of the connecting (SF) hose 58. This allows pressure to the recovery unit inlet 60, and the system pressure (SG) gauge 74 will reveal the system pressure.

L. Open the storage cylinder (SCC) valve 98. This will cause the storage cylinder (PI) gauge 92 to read the cylinder pressure. Allow the recovery unit chiller system 12 to operate until the storage cylinder pressure is down to the temperature equivalent of about 10° F. or below in this embodiment.

M. Open the storage cylinder shut off (SCS) valve 86 and the system shut off (SSO) valve 68. Observing the sight (SG) glass 74 while opening the system shut off (SSO) valve 68 will show bubbles in the sight (SG) glass 74 until the pressure in the filter/drier (FD) 70 and sight glass (SG) 74 build to the system pressure.

N. When the pressure/temperature in the storage cylinder 16 reaches about 15° F. or less in this embodiment, liquid refrigerant has left the refrigerated system that was to be emptied and the glass (SG) 74 empties. If the refrigerated system to be emptied holds more than about 30 pounds of refrigerant, the brine level in the chiller drum 18 must be constantly checked to prevent over filling the storage cylinder 16.

If the storage cylinder 16 is filled and refrigerant still remains in the refrigerated system (not shown), close the storage cylinder (SCS) valve 86 and allow the pressure in the storage cylinder connecting (SCF) hose 96 to drop to cylinder pressure. After closing the storage cylinder (SCS) valve 86 and, without disconnecting the (SCF) hose 96, remove the filled cylinder 16 from the chiller drum 18. Insert another storage cylinder 16 and transfer the (SCF) hose 96 from the filled cylinder 16 to the new cylinder (SCC) valve 98 and observe the cylinder pressure. When the cylinder pressure/temperature is below 15° F., open the storage cylinder shut off (SCS) valve 86 and repeat the above operation or step "M". Repeat this process until the system has been emptied of the refrigerant in liquid state and only vapor refrigerant remains.

O. With the system pressure low enough to indicate refrigerant vapor only, use the vapor (VP) pump 100 to remove the remaining vapor. Close the liquid by-pass (BSO) valve 78 and open the vapor pump out shut off (VPO) valve 120 and the vapor pump in shut off (VPI) valve 114.

Operate the pump until the system pressure is below 5 Psig. Do not pull the system pressure into the vacuum range.

The evacuation process is now complete.

P. After shutting the recovery unit 10 down and disconnecting it from the system (plug the finger tight coupling on the line shut off valve), replace the filter/drier (FD) 70 in the recovery unit 10, to prepare it for the next job.

Q. Remove the storage cylinder 16 from the chiller drum 18. Wipe all brine 20 off the cylinder 16.

If the refrigerant is to be returned to the refrigerated system (not shown) after the system (not shown) is repaired and properly evacuated, the cylinder 16 should be immersed in hot water (maximum 125° F.) to build the pressure in the storage cylinder 16.

The operating procedure for an acid contaminated system is indicated hereafter.

The refrigerant in the acid contaminated refrigerant system (not shown) is connected directly between the system and the storage cylinder 16 without passing through the refrigerant recovery unit 10.

Storage cylinders and connecting hoses used on acid contaminated refrigerant systems are not used for any other purpose. Using these cylinders and hoses on other systems will start acid formation in the other systems.

A. Check the level of brine 20 in the chiller tank 18 and bring it up to the proper level on the depth gauge.

B. Insert the acid refrigerant storage cylinder 16 into the chiller drum 18 and start the chiller 12.

C. Using an immersion type thermometer, operate the chiller 12 until a brine temperature of 0° F. or lower is obtained.

D. Open the hose (SCV) valve 56 at the refrigerant system to be evacuated (not shown) and the storage cylinder (SCC) valve 98. Allow the system to operate until the brine temperature reaches the temperature before the evacuation process was started. This will remove all the acid contaminated refrigerant with only a slight amount of vapor in the system.

While the invention has been described in its preferred embodiment, it is to be understood that the words which have been used are words of description rather than limitation and that changes may be made within the purview of the appended claims without departing from the true scope and spirit of the invention in its broader aspects.

I claim:

1. A refrigerant recovery apparatus for draining refrigerent liquid from a refrigeration comprising, in combination:

a chiller unit, said chiller unit comprising a drum having a fluid therein and an chiller coil disposed in said drum;

piping circuit means for connected to the refrigeration system; and storage cylinder means connected to the piping circuit means and disposed within the chiller unit for collecting the refrigerant liquid when cooled.

2. A refrigerant recovery apparatus for draining refrigerant liquid from a refrigeration system comprising, in combination:

a chiller unit;

piping circuit means for connection to the refrigeration system; and storage cylinder means connected to the piping circuit means and disposed within the chiller unit for collecting the refrigerant liquid when cooled;

the chiller unit includes:

a drum having a brine solution;

a chiller coil disposed in the drum, a condenser having a chiller power switch;

spring-supported platform means for supporting the storage cylinder means inside the drum;

a liquid level gauge mounted on the drum for measuring the depth of the brine solution and for indicating the weight and level of refrigerant liquid in the storage cylinder means; and a support framework for supporting the drum and condenser and piping circuit means.

3. The apparatus of claim 2 wherein the piping circuit means includes:

refrigerator system control valve means for connection to the refrigerator system;

a recovery system control valve connected to the refrigerator system control valve means through an inlet hose;

a vapor pump bypass valve connected to the recovery system control valve through an inlet tube;

a shut off valve connected to the vapor pump bypass valve through an inlet tube; and a storage cylinder control valve connected to the shut off valve through an inlet tube and connected to the storage cylinder means through an outlet connection.

4. The apparatus of claim 3, wherein the piping circuit means includes:

a pressure gauge connected to the inlet tube of the recovery system control valve;

a filter/drier assembly connected to an outlet tube of the recovery system control valve;

a sight glass connected to an outlet of the filter/drier assembly and connected to an inlet tube of the vapor pump bypass valve; and a second pressure gauge connected to the inlet tube of the storage cylinder control valve.

5. The apparatus of claim 4 wherein the piping circuit means includes:

an external vacuum pump control valve connected to an outlet of the sight glass through an inlet tube and having an outlet for connection to a vacuum pump.

6. The apparatus of claim 5, wherein the piping circuit includes:

a vapor pump having an inlet tube and outlet tube;

a vapor pump inlet valve having an inlet tube connected to the inlet tube of the external vacuum pump control valve and having an outlet connected to the inlet tube of the vapor pump; and a vapor pump outlet valve having an inlet connected to the outlet tube of the vapor pump and having an outlet tube connected to the inlet tube of the shut off valve.

7. A method of recovering refrigerant including the steps of:

mounting a chiller unit at a location remote from a refrigerator system to be drained of refrigerant, said chiller unit comprising a drum having a fluid therein and a chiller coil disposed in said drum;

disposing a storage cylinder in the chiller unit;

connecting a piping circuit having a shut off valve to the storage cylinder;

connecting an elongate hose having a shut off valve at one end to the refrigerator system and connecting the hose at an opposite end to the piping system; and lowering the temperature of the storage cylinder for moving the refrigerant liquid to the storage cylinder after opening the valves.

8. A method for draining refrigerant liquid from a refrigeration system comprising, in combination:

providing a chiller, said chiller unit comprising a drum having a fluid therein and a chiller coil disposed in said drum;

connecting piping circuit means to the refrigeration system; and connecting storage cylinder means connected to the piping circuit means and disposed within the chiller unit for collecting the refrigerant liquid when cooled.

* * * * *